US006125825A

United States Patent [19]

Sanchez et al.

[11] Patent Number: 6,125,825

[45] Date of Patent: Oct. 3, 2000

[54] FUEL PUMP ASSEMBLY FOR MOTOR VEHICLE AND TANK EQUIPPED WITH SAME

[75] Inventors: Michel Sanchez; Alain Bournel; Christophe Gouzou, all of Chalons-en-Champagne, France

[73] Assignee: Marwal Systems, France

[21] Appl. No.: 09/331,551

[22] PCT Filed: Dec. 18, 1997

[86] PCT No.: PCT/FR97/02350

§ 371 Date: Jun. 18, 1999

§ 102(e) Date: Jun. 18, 1999

[87] PCT Pub. No.: WO98/28536

PCT Pub. Date: Jul. 2, 1998

[30] Foreign Application Priority Data

Dec. 20, 1996 [FR] France ..... 96 15769

[51] Int. Cl.[7] ..... F02M 37/04

[52] U.S. Cl. ..... 123/509; 123/468; 123/467; 123/510

[58] Field of Search ..... 123/509, 468, 123/469, 467, 510

[56] References Cited

U.S. PATENT DOCUMENTS

| | | | |
|---|---|---|---|
| 4,747,388 | 5/1988 | Tuckey | 123/510 |
| 4,971,017 | 11/1990 | Beakley | 123/510 |
| 5,476,080 | 12/1995 | Brunnhofer | 123/468 |
| 5,647,330 | 7/1997 | Sawert et al. | 123/509 |
| 5,718,208 | 2/1998 | Brautigan et al. | 123/509 |
| 5,797,376 | 8/1998 | Frank et al. | 123/509 |

FOREIGN PATENT DOCUMENTS

| | | |
|---|---|---|
| 0297256 | 1/1989 | European Pat. Off. . |
| 2936773 | 4/1981 | Germany . |
| 3821020 | 12/1989 | Germany . |

OTHER PUBLICATIONS

Patent Abstracts of Japan, vol. 17, No. 671 Dec. 10, 1993.
Patent Abstracts of Japan, vol. 96, No. 5 May 31, 1996.
Patent Abstracts of Japan, vol. 13, No. 469 Oct. 24, 1989.

*Primary Examiner*—Thomas N. Moulis
*Attorney, Agent, or Firm*—Blakely Sokoloff Taylor & Zafman

[57] ABSTRACT

The present invention relates to a fuel pump assembly for a motor vehicle, the assembly being characterized by the fact that it comprises a damping device (42) formed on the outlet of a pump (20) by a sleeve made of compressible material.

7 Claims, 1 Drawing Sheet

FUEL PUMP ASSEMBLY FOR MOTOR VEHICLE AND TANK EQUIPPED WITH SAME

The present invention relates to the field of fuel drawing assemblies for motor vehicles.

The present invention applies in particular to drawing assemblies comprising an electric pump, immersed in the tank of the motor vehicle.

The pump system of such assemblies is often a source of noise of vibrating or pulsating origin.

In an attempt to limit the pulsating noises, various types of damping devices have already been proposed. For example, proposals have thus been made which include damping components comprising a deformable membrane, damping devices based on a Helmholtz resonator or on hydraulic capacity, or even damping devices formed by a hollow body having a thin wall of flexible and resilient material and containing compressible gas (see for example documents FR-A-2 709 791 and U.S. Pat. No. 5,122,039).

Document DE-A-3 821 020 describes a flexible connection between two segments of a pump outlet duct comprising a resilient sleeve housed in a stack of support washers, that are themselves placed in an external helical spring.

However, those various known solutions are not entirely satisfactory. Most of them have the drawback of being very bulky and/or not very reliable.

The object of the present invention is to propose a new pulsation-damping device that is adapted to be integrated in a fuel pump assembly.

In the present invention, this object is achieved by means of a pump assembly comprising a plate adapted to be fixed on the top wall of a fuel tank, a support body which is connected to said plate and which houses an electric pump having an outlet formed by a plug endpiece, the plate carrying a socket tube which projects downwards from the plate to co-operate with the plug endpiece, and a damping device formed by a sleeve made of compressible material that is disposed in the connection between the socket tube and the plug endpiece, the assembly being characterized by the fact that the damping sleeve is placed inside the socket tube, and the sleeve is made of a foam material having closed airtight cells.

The present invention also relates to tanks fitted with such a pump assembly.

Figure 1:
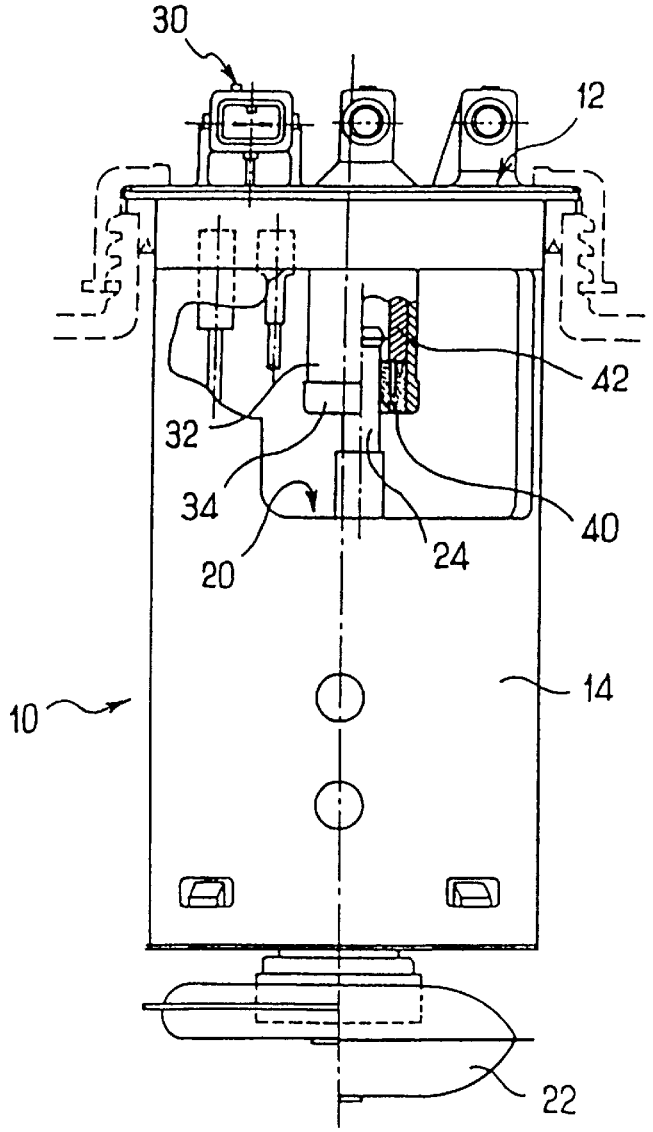
Figure 2:
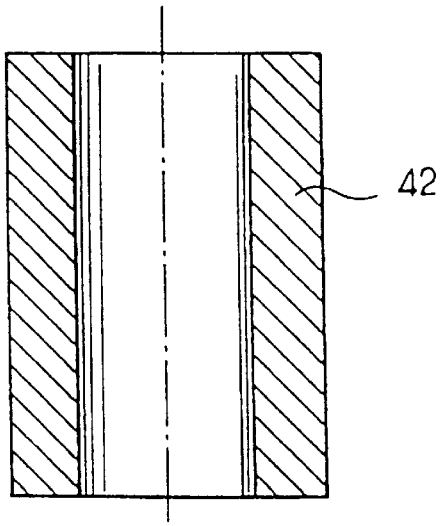

Other characteristics, objects, and advantages of the present invention appear on reading the following detailed description, and with reference to the accompanying drawing given by way of non-limiting example, and in which:

FIG. 1 is a diagrammatic view, partially in section, of a pump assembly of the present invention; and FIG. 2 is a view in longitudinal section of a damping sleeve of the present invention.

Accompanying FIG. 1 shows a pump assembly 10 of conventional general structure comprising a plate 12 adapted to be fixed on the top wall of a fuel tank, and a support body 14 which is connected to said plate 12 and which houses an electric pump 20 having an inlet provided with a filter 22 and having an outlet formed by a plug endpiece 24.

The plate 12 carries electrical contacts 30 and a plurality of socket tubes, one of which socket tubes 32 projects downwards from the plate 12 to receive the plug endpiece 24.

In addition, an annular gasket 40 is interposed between the outside surface of the plug endpiece 24 and the inside surface of the socket tube 32. The annular gasket 40 may be embodied in a wide variety of ways. It is preferably a double-lipped gasket as shown in FIG. 1, with each lip respectively resting on the outside surface of the plug endpiece 24 and on the inside surface of the socket tube 32, said lips being interconnected via a ring-shaped radial partition at one of their axial ends.

A metal cap 34, made of stainless steel for example, is preferably fixed to the base of the socket tube 32, e.g. as a force fit, in order to hold the gasket 40 and the damping sleeve 42 in place.

The general structure described above, conventional in itself, is not described in detail below.

It is noted, however, that in the context of the present invention, a damping sleeve 42 is placed inside the socket tube 32. The sleeve 42 is thus placed inside the fuel duct connecting the outlet of the pump 20 to the outlet in the plate 12 which is designed to be connected to the end use (carburetor or injector unit) in contact with the fuel.

The sleeve 42 is preferably made of a foam material having closed airtight cells, e.g. based on a nitrile-PVC or a fluorosilicone material.

The sleeve 42 is advantageously made of a material of low density, typically about 250 kg/m$^3$.

In addition, the sleeve 42 is made of a material having a Young's modulus lying in the range 0.4 MPa to 0.8 MPa.

In an embodiment given by way of non-limiting example, the sleeve 42 has a length of about 26 mm, an inside diameter of about 10 mm, and an outside diameter of about 18 mm.

The sleeve 42 enables pulsations to be dampened by compensating the variations in volume generated by said pulsations.

It is noted that the damping device 42 of the present invention can be integrated in the assembly ensuring the connection between the pump 20 and the mechanical support 12, merely by being implanted therein, without requiring any special mechanical fixing system.

The present invention thus enables the pulsating noise to be dampened effectively, at low cost, and without increasing the bulkiness of known pump assemblies.

Naturally, the present invention is not limited to the particular embodiment described above, but extends to any variant within the spirit thereof.

What is claimed is:

1. A fuel pump assembly for a motor vehicle, the assembly comprising a plate (12) adapted to be fixed on the top wall of a fuel tank, a support body (14) which is connected to said plate (12) and which houses an electric pump (20) having an outlet formed by a plug endpiece (24), the plate (12) carrying a socket tube (32) which projects downwards from the plate (12) to co-operate with the plug endpiece (24), and a damping device (42) formed by a sleeve made of compressible material that is disposed in the connection between the socket tube (32) and the plug endpiece (24), the assembly being characterized by the fact that the damping sleeve (42) is placed inside the socket tube (32), and the sleeve (42) is made of a foam material having closed airtight cells.

2. An assembly according to claim 1, characterized by the fact that the sleeve (42) is based on nitrile-PVC or fluorosilicone.

3. An assembly according to claim 1 or 2, characterized by the fact that the sleeve (42) is made of a material of low density, typically of about 250 kg/m$^3$.

4. An assembly according to any one of claims 1 to 3, characterized by the fact that the sleeve (42) has a Young's modulus lying in the range 0.4 MPa to 0.8 MPa.

5. An assembly according to any one of claims 1 to 4, characterized by the fact that the sleeve (42) has a length of about 26 mm, an inside diameter of about 10 mm, and an outside diameter of about 18 mm.

6. An assembly according to any one of claims 1 to 5, characterized by the fact that it further comprises an annular gasket (40) interposed between the outlet plug endpiece (24) of the pump (20) and a socket tube (32) receiving said plug endpiece (24).

7. A fuel tank for a motor vehicle, characterized by the fact that it includes a pump assembly fitted with a damping device (42) according to any one of claims 1 to 6.

* * * * *